United States Patent [19]

Wilson

[11] 4,232,310

[45] Nov. 4, 1980

[54] PROTECTIVE WINDOW SCREEN ASSEMBLY

[75] Inventor: Clarence P. Wilson, Torrance, Calif.

[73] Assignee: Imperial Screen Company, Inc., Lawndale, Calif.

[21] Appl. No.: 40,660

[22] Filed: May 18, 1979

[51] Int. Cl.[3] ..... G08B 13/08; A47G 5/00

[52] U.S. Cl. ..... 340/550; 160/10; 160/354; 160/371; 160/380; 200/61.08; 200/61.93; 200/DIG. 12

[58] Field of Search ..... 340/550; 200/61.08, 200/61.93, DIG. 12; 160/10, 377, 371, 354, 380, 392, 393, 394, 399

[56] References Cited

U.S. PATENT DOCUMENTS

| | | | |
|---|---|---|---|
| 2,297,729 | 10/1942 | Thomas | 160/354 |
| 3,087,145 | 4/1963 | Fruh | 200/61.93 |
| 3,455,367 | 7/1969 | Tarte | 160/371 |
| 3,569,645 | 3/1971 | Lea | 200/61.93 |
| 3,696,373 | 10/1972 | Dunn et al. | 340/550 |
| 3,725,891 | 4/1973 | Miller | 340/550 |

*Primary Examiner*—Glen R. Swann, III

*Attorney, Agent, or Firm*—Freilich, Hornbaker, Wasserman, Rosen & Fernandez

[57] ABSTRACT

A screen assembly includes a rectangular mesh sheet with several parallel security strands of insulated conductive wire extending between opposite sides of the sheet. Insulated cross wires lie on a face of the mesh near the opposite sides thereof, are joined by welding or soldering to points on the security strands, and are cut at selected locations to provide a sinuous electrical path through the screen. A spline of insulative material extends around the border of the mesh sheet and encapsulates the locations where the cross wire is joined to the security strands, the spline including upper and lower spline portions lying on opposite faces of the mesh and sealed together through the mesh. A frame for holding the screen includes a pair of frame halves that snap together, with the lower half having an undercut slot that receives a flange at the periphery of the spline, the lower frame half also having a stop surface opposite the undercut slot which abuts the inner edge of the spline.

15 Claims, 5 Drawing Figures

FIG. 1
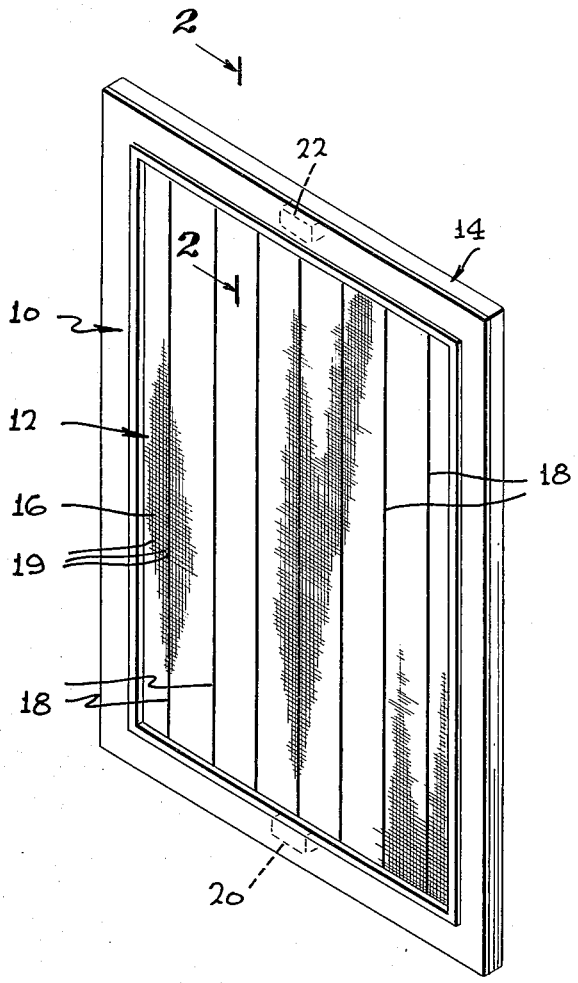
FIG. 2
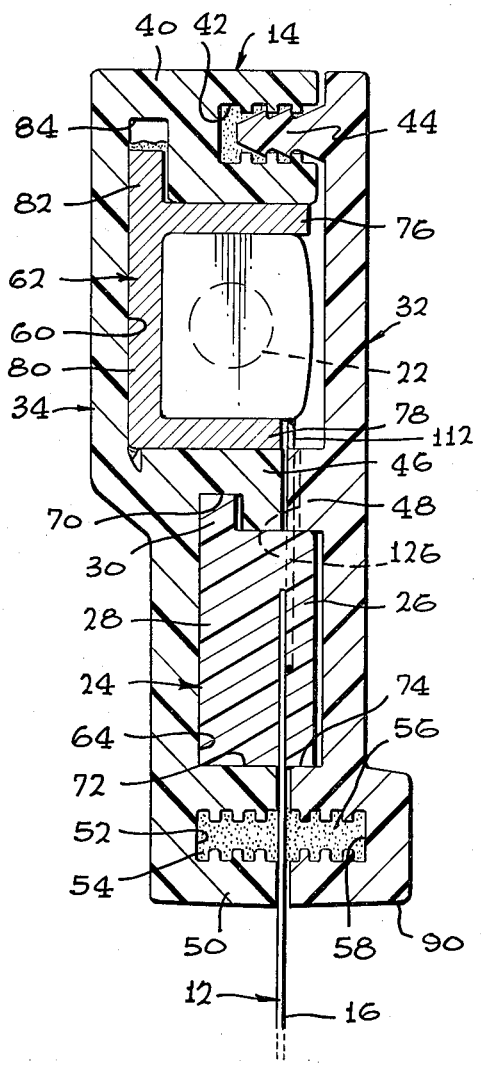
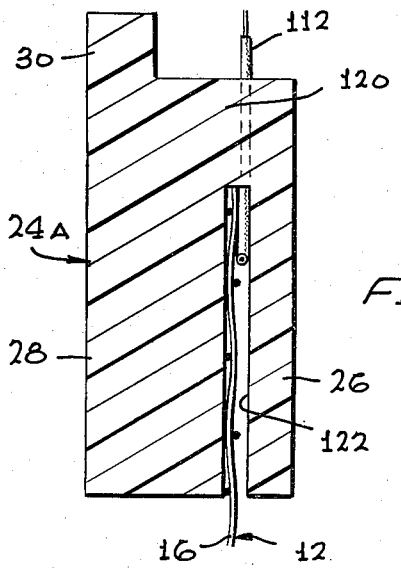
FIG. 4

PROTECTIVE WINDOW SCREEN ASSEMBLY

BACKGROUND OF THE INVENTION

One method for constructing an alarm or security screen, includes weaving a mesh with several parallel insulated conductive wire security strands, and then cutting a rectangular sheet therefrom. As described in my earlier U.S. Pat. No. 3,051,935, opposite sides of the mesh sheet can be trimmed away to leave projecting lengths of the security strands. The security strands can be connected together and to a plug and tamper switch, to provide a conductive path that permits current to flow in a sinuous path covering the screen area, between the plug and switch. The edges of the mesh then can be held to a screen frame by rolling them into a frame by forcing a resilient rod-shaped spline over the mesh and into a groove in the frame. The inner connections of the security strands are sealed on opposite ends to keep out moisture. Considerable labor is involved in trimming away the mesh, in making the interconnections of the security strands, and in installing and sealing the screen edges. Furthermore, if the mesh is damaged, the entire screen assembly which includes the frame, normally has to be returned to the factory for repair, because of the intricacies in installing the mesh into the frame and sealing it therein. A technique for constructing screens, and especially security screens, which facilitated their manufacture and reliable installation would reduce the cost of initially constructing the screen and facilitate repairs thereto.

SUMMARY OF THE INVENTION

In accordance with one embodiment of the present invention, a protective screen assembly is provided which is reliable and which can be easily constructed and repaired. A screen assembly utilized to trigger an alarm if broken, includes a rectangular mesh with parallel insulated conductive wire security strands extending between its opposite sides, and a cross wire lying on a face of the mesh along either side portion. The cross wires are spot connected, by soldering or welding, to locations where they cross the security strands, and the cross wires are cut, so as to provide a sinuous current path that repeatedly crosses the screen. The connection points are sealed against moisture by a spline that extends around the border of the mesh. The spline has upper and lower portions which lie over opposite faces of the mesh and which are sealed together through the mesh to encapsulate the locations where the cross wires connect to the security strands.

A screen frame is provided to securely hold the edges of the screen by holding the spline thereof. The frame includes upper and lower halves that can be snapped together around the spline, to thereby hold the screen in place. The spline is formed of flexible material, so that a replacement screen can be rolled up for shipment in a long narrow container. The spline is formed with a flange on its outer edge, which can be received in an undercut slot of the bottom frame member. The frame member also has a stop surface opposite the undercut slot, which can abut the inner edge of the spline. Accordingly, tension in the screen mesh is withstood by abutment of the frame's stop surface with the spline inner edge, while the undercut slot prevents lift up of the spline that can cause loss of mesh tension and delamination of the mesh from the spline.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a screen assembly constructed in accordance with the present invention.

FIG. 2 is a view taken on the line 2—2 of FIG. 1.

FIG. 4 is a partial sectional view of a screen assembly, showing the spline and screen edge installed therein, but prior to completion of the spline installation.

DESCRIPTION OF THE PREFERRED EMBODIMENT

Figure 3:
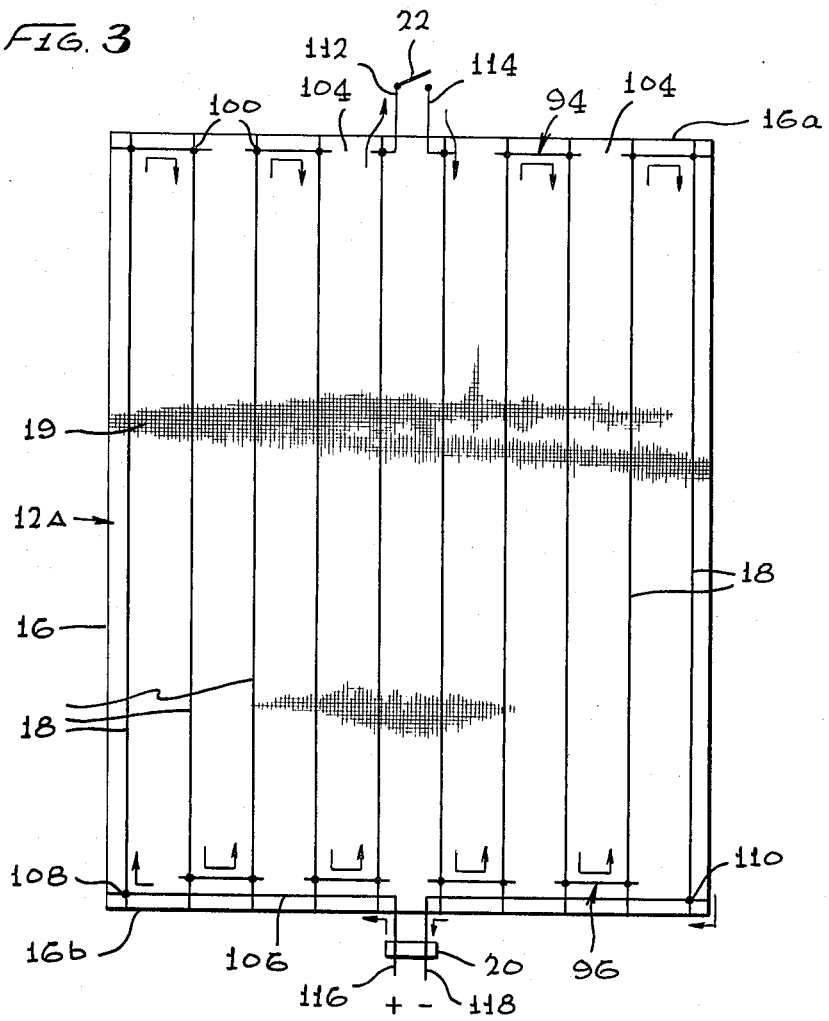
FIG. 3 is a plan view of a protective mesh of the screen assembly of FIG. 1.
Figure 5:
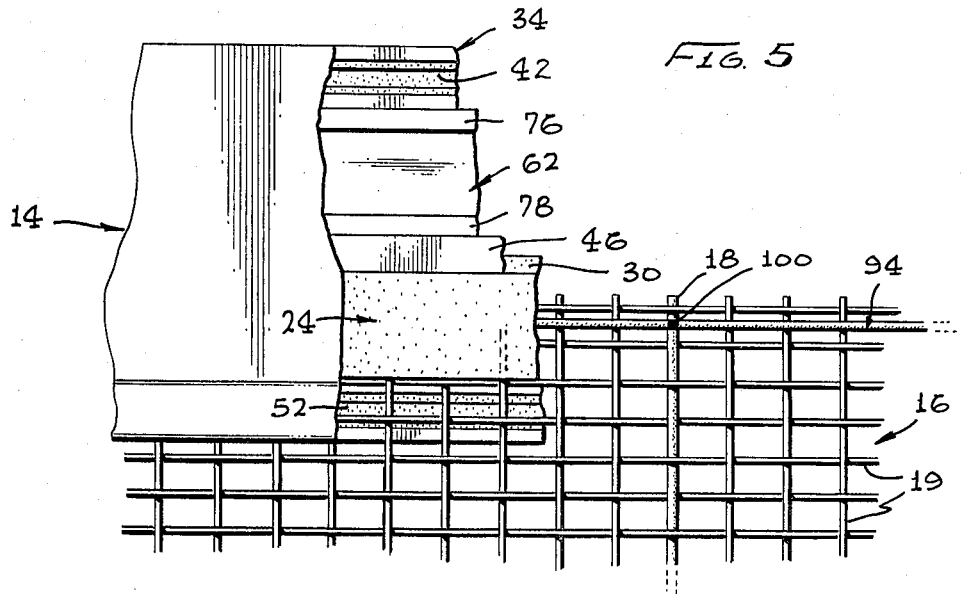
FIG. 5 is a plan view of a portion of the screen assembly of FIG. 1.

FIG. 1 illustrates a screen assembly 10 which includes a security screen 12 held in a frame 14. The security screen 12 includes an insect mesh 16 of closely woven mesh strands 19 of a nonconductive, or dielectric, material such as a plastic, and several security strands 18 of an insulated electrical wire. In the use of the screen assembly, a plug 20 at one side of the screen is connected to a current source that passes current in series through the security strands 18, so that if any of the strands 18 are broken, an alarm is triggered. In addition, a tamper switch 22 is provided along one edge of the screen assembly, to detect removal of the screen assembly. For example, the switch 22 may be a reed switch which is held closed when lying adjacent to a magnet on the frame opening of a building, and which opens when separated from the magnet, and with the switch 22 connected in series with the security strands 18.

FIG. 2 illustrates some of the details of the security screen 12 and of the frame 14 that holds it. The border region of the mesh 16 is held by a spline 24. The spline includes upper and lower portions 26, 28 that lie on opposite surfaces of the mesh 16 and which are joined to one another through the mesh. The lower spline portion includes a flange 30 extending outwardly from the outer side or periphery of the spline which is opposite the center of the mesh 16. The frame 14 includes upper and lower halves 32, 34 which can be snapped together around the spline 24 of the screen, to securely hold the spline in position. It should be noted that the terms "upper" and "lower" spline portion or frame half, are used here to facilitate description of the invention, and not to designate the positions of these parts in a final installation.

The lower frame half 34 includes an outer portion 40 forming a groove 42 for receiving a tongue 44 of the other frame half, and a middle wall 46 that can abut a middle wall 48 of the upper frame half. The lower frame half also includes an inner wall 50 forming a groove 52 that can hold a sealing compound 54 that can seal through the screen mesh to a quantity of the same compound 56 lying in a corresponding groove 58 of the upper frame half. The lower frame half also includes an outer recess 60 which can hold a stiffener 62, and an inner recess 64 which can hold the spline 24.

The spline 24 of the security screen can be installed on the frame by positioning the spline flange 30 in an undercut slot 70 of the lower frame half. The spline is preferably made wide enough so that it is held in a slight interference fit between the end of the undercut slot 70 and a stop surface 72 formed at the inner side of the recess 64 opposite the undercut slot 70. Tension in the mesh 16 tends to pull the spline 24 out of the frame, and also to delaminate the mesh 16 from the spline. The combination of the undercut slot 70 and the stop surface 72 effectively resists this. Tension in the mesh 16 is first resisted by abutment of the inner side of the spline with the stop surface 72 on the lower frame half. However, if the spline were not held down, tension in the screen would tend to lift up the outer edge of the spline. The spline would tend to separate the inner frame portions 50, 90 and move into the space between them, which would lower mesh tension. If the spline could not reduce tension, then lift up of the outer edge of the spline could cause the mesh 16 to tear away from the lower portion 28 of the spline. The reception of the spline flange 30 in the undercut slot 70, serves to resist such lift up of the spline and consequent loss of mesh tension and possible delamination of the spline from the mesh. In addition, the upper frame half is provided with a stop surface 74 which abuts the inner edge of the upper spline portion 26.

The frame halves 32, 34 are constructed of plastic, which may be formed through an extruding die. The stiffener 62 is preferably formed of a stiff material such as a metal which is nonmagnetic, such as aluminum, which can be extruded or rolled. The stiffener 62 is formed in a generally U-shape, with a pair of arms 76, 78 lying against opposite walls of the lower frame recess, and with a base 80 having a projection held in an undercut slot 84 of the lower frame half. The stiffener can be adhesively held in place in the lower frame half.

The screen 12 can be installed in the frame by first slipping the spline 24 into the lower frame half recess 64. The upper frame half 32 then can be joined to the lower half by aligning the tongue 44 of the upper half with the groove 42 in the lower half and pressing the two halves together. Prior to such pressing, a sealant such as silicone rubber can be installed in the grooves 42, 52 of the lower frame half, and in the groove 58 of the upper frame half. This can provide added protection against the entrance of moisture into the inside of the frame where such added protection is deemed necessary, as will be described below.

A person can snap the two frame halves 32, 34 together around the spline 24, as by laying one frame half on a surface and pressing down on the other frame half with a moderately high force. Due to the fact that the security strands 18 of the mesh are somewhat thicker than the rest of the strands thereof, it would be possible to damage the security strands 18 by clamping them hard between the inner portion 50 of the lower frame half and the inner portion 90 of the upper frame half. The two middle walls 46, 48 of the frame halves help avoid such damage, because they abut one another when the tongue 44 of the upper frame half has been fully installed in the groove 42 of the lower frame half.

FIG. 3 shows a partially constructed screen 12A, which can be formed by first cutting a rectangular mesh 16 from a roll of alarm security mesh which has the security strands 18 woven into the mesh strands 19. The mesh 16 has a first pair of opposite edges or sides **16*a*, 16*b* between which the security strands 18 extend. These opposite sides 16*a*, 16*b* may eventually lie at the top and bottom of an installed screen or at laterally spaced positions, but are herein referred to as opposite sides. After the mesh sheet 16 has been cut, a pair of cross wires 94, 96 are laid on the screen at opposite sides thereof. Each cross wire such as 94 is an insulated electrically conductive wire similar to that of the security strands 18, and includes a conducive core of a material such as copper surrounded by a layer of insulation such as Teflon. The cross wire 94 is laid on the face of the mesh along a side portion thereof inside the extreme edge of the mesh, and is then joined at connections points 100 to the security strands 18. Such joining can be accomplished in several different ways. In one technique, the cross wire 94 is welded to each security strand 18 by through-insulation welding wherein a pair of electrodes press the two wires together with sufficient force to crush through the insulation, and then pass current through the wires to weld them together. In another technique, a small region of insulation is removed from the security strand and cross wire at their intersection, and the conductive cores of the security strand wire and cross wire are soldered or welded together. The cross wire can be fed through a weld electrode. The cross wire 94 can be cut at several locations such as 104, so that individual sections of the cross wire 94 serve only to connect pairs of adjacent security strands. The other cross wire 96 can be similarly installed at the opposite side of the mesh. In addition, another cross wire 106 can be installed along one edge 16*b* of the mesh to connect it at 108 and 110** to two of the security strands.

When the cross wire 94 is initially installed, it is formed with a loop at the center, which is eventually cut to form a pair of leads 112, 114 that can connect to the tamper switch 22. Similarly, the additional cross wire 106 is formed with a loop that is cut and joined to the plug 20. As can be seen in FIG. 3, when the plug 20 is connected to a current source, current can flow from the plug lead 116 along the path indicated by current arrows, through the switch 22 and back to another plug lead 118. If any of the strands 18 are cut, or if the tamper switch 22 is opened, the circuit is opened and current cannot flow from one plug lead 116 to the other 118. A circuit (not shown) connected to the plug 20 triggers an alarm when current flow stops.

While the screen 12A of FIG. 3 provides a complete electrical circuit to an alarm circuit, it is difficult to hold the screen 12A in position, and the locations where the security strands 18 connect to the cross wires 94, 96, and 106 may be exposed and subject to corrosion or even short circuiting from moisture. The spline 24 serves to protect the connection points 100 where the security strands are connected to the cross wires, and also to facilitate mounting of the screen to the frame.

FIG. 4 shows the spline 24A prior to its complete attachment to the mesh 16. The spline at 24A is formed of a strip of insulative flexible material such as a flexible vinyl, with the upper and lower portions 26, 28 joined through a middle portion 120, and with a slot 122 being provided to receive the edge of the mesh 16. When the mesh has been received to the bottom of the slot 122, the upper and lower portions 26, 28 of the spline are joined together through the screen, as by dielectrically welding them utilizing high frequency currents. The upper and lower spline portions 26, 28 are securely fastened to the mesh due to the joining of the spline portions through the mesh, and serve as a good moisture seal for preventing corrosion and short circuiting of the electrical connections where the cross wires and security strands are in contact. In the construction of the apparatus, the leads such as 112 of the cross wires which connect to one of the elements such as the tamper switch 22, are passed through a slit formed in the middle region 120 of the spline. The end of the lead 112 is connected to the tamper switch 22, and the tamper switch and the location where it is electrically joined to the lead 112 is potted as by encapsulating it in silicone. As shown in FIG. 2, the tamper switch or sensor 22 and the encapsulant 124 which serves as a tamper switch mount, are positioned between the arms 76, 78 of the stiffener 62. A slot 126 is milled in one of the middle walls 48 of the frame to pass the leads such as 112. A typical reed switch 22 includes a glass housing, and the stiffener 62 helps protect the glass housing from bending and breaking. A similar arrangement is provided for the plug 22 at the opposite side of the screen assembly, with the stiffener and other portion of the frame being milled out to receive the plug.

In one screen assembly design, the screen mesh was formed of 13 mil (thousandths of an inch) polyvinyl mesh strands of about eighteen-fourteen mesh, with the security strands 18 formed of electric wire of eighteen mil diameter including the Teflon insulation around the core. The security strands 18 were spaced 4 inches apart and woven into the mesh. The spline 28 was formed of flexible vinyl of 80 shore durameter, having an initial width of 7/16th inch and thickness of 0.187 inch. The flexible spline permits the screen 12 to be rolled up for shipment. If an alarm screen is cut or otherwise damaged, it can be replaced without returning the frame to the factory. Instead, when the dimensions of the screen are given, the factory can ship just the screen 12 to the user. A screen can be installed by prying apart the frame halves 32, 34, as by inserting a thin screwdriver blade between them at their outer edge to pry the tongue 44 out of the groove 42. The silicone sealing compound is easily broken apart. The spline of the old screen can be pulled out and the new spline inserted in the lower frame half. The screen can be provided with the tamper switch and plug already connected thereto, if desired, so that all elements are already sealed against moisture. The two frame halves can be again joined together by merely pressing the tongue 44 into the groove 40. For best corrosion protection, a tube of silicone sealant can be provided to seal the two frame halves together against the entrance of moisture, by applying the sealant to the three grooves 42, 53, 58 of the frame halves and with the sealant extending through the mesh. The sealant also helps protect the aluminum stiffener 62 against corrosion from salt water.

Thus, the invention provides a reliable protective screen assembly which can be fabricated and repaired at relatively low cost. A mesh is securely held at its border by a spline having upper and lower portions sealed together through edge portions of the mesh. The spline can be held in a frame by the receipt of a flange at the outside of the spline in an undercut slot of the frame, and with the frame having a stop surface that abuts an inner edge of the spline. The screen assembly is useful not only for an alarm screen, but also in an ordinary protective screen without security strands, to facilitate mesh installation by an unskilled person. The spline is especially useful in an alarm screen to also protect the connection points where security strands of the screen are connected together. An alarm screen can be formed by cutting a mesh into a rectangular screen of desired size, and laying a cross wire over a face of the mesh along opposite edges thereof between which the security strands extend. Points along the cross wire can be joined to the security strands as by welding or soldering them into contact with one another. The spline which is intimately joined to opposite faces of the screen lies around the connection points to protect them from moisture. The spline of a screen can be formed of flexible material so that a replacement screen can be rolled up for storage and shipment.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. An alarm screen assembly comprising:

a screen mesh sheet formed primarily of nonconductive strands and also including a plurality of insulated electrically conductive security strands extending parallel to one another, said mesh sheet having a pair of opposite sides and said security strands extending largely perpendicular to and between said sides;

a pair of electrically conductive cross wires extending along opposite sides of said mesh sheet and electrically connected to said security strands; and a spline extending along the border of said mesh sheet, said spline having upper and lower spine portions lying on opposite faces of said mesh sheet and over the locations where said cross wires are connected to said security strands, and said spline portions joined together through said mesh sheet, whereby to protect the electrical connections from moisture and aid in mounting the mesh sheet.

2. The assembly described in claim 1 wherein:

said spline has a flange located at the lower outer edge thereof; and including a frame having upper and lower frame halves, said lower frame half including walls forming a groove for receiving said lower spline portion, said groove having an outer side forming an undercut slot to receive said spline flange, and forming a stop surface at the inner side of said groove to abut the inner edge of said lower spline surface.

3. The assembly described in claim 1 including:

a frame having upper and lower frame halves, each having inner, outer, and middle portions, and forming a recess between said inner and middle portions for holding said spline and with said mesh extending between the inner portions of the two frame halves;

said outer portions of said frame halves forming a tongue and groove, and said middle portions being thick enough to abut each other when the tongue is fully inserted into the groove, whereby to avoid excessive clamping force on the security strands.

4. The assembly described in claim 1 wherein:

said cross wires each lie on a surface of the mesh sheet at a location inside the extreme edge of the mesh sheet, and are electrically joined to said security strands at connection spots where the strand and cross wire cross, and each cross wire includes a single wire with a loop at the center and which is cut at locations between pairs of security strands and also along the loop.

5. In a screen assembly which includes upper and lower rectangular screen frame halves that can be detachably fastened together and which form a recess between them, the improvement of a screen mountable therein comprising:

a flexible rectangular mesh; and a spline of flexible material extending along the periphery of said mesh and formed to lie in said frame recess, said spline having upper and lower flexible portions lying on opposite faces of said mesh and bonded together through said mesh, whereby to enable a replacement screen to be rolled up for shipment and installed by a homeowner or the like.

6. The improvement described in claim 5 wherein said lower spline portion has an outwardly-extending flange at its periphery; and including a screen frame having upper and lower halves, said lower half having a recess for receiving said lower spline portion, said recess having an outer side with an undercut slot for receiving said spline flange, and an inner side having a stop surface for abutting the inner edge of the spline.

7. The improvement described in claim 6 wherein:

the lower portion of said spline has a great enough width to form an interference fit with the inner and outer walls of said recess of said lower frame half.

8. An alarm screen assembly comprising:

an open rectangular frame having upper and lower halves and having an outer side containing means for fastening the halves together, said frame forming an inner recess between said halves;

a screen having a rectangular mesh with opposite sides, said mesh including a plurality of parallel security strands of insulated electrically conductive cores extending between opposite sides of the mesh, said screen having cross wires at opposite sides of the mesh which each lie on a surface of the mesh and are electrically joined to the conductive cores of said security strands, and having a spline of insulative material which encapsulates said security strands and cross wires at the locations where they are electrically joined;

said spline lying trapped in said frame inner recess, with said mesh extending across the space within said open frame.

9. The assembly described in claim 8 wherein:

said frame forms an outer recess between said frame halves, and includes a largely U-shaped stiffener in said outer recess, said frame formed of plastic material and said stiffener formed of nonmagnetic metal material; and including a magnetic tamper switch device including a sensor coupled to one of said cross wires, and a mount surrounding the sensor and lying between the arms of the U-shaped stiffener.

10. The assembly described in claim 8 wherein:

one of said frame halves includes a tongue and the other a groove at the outer side of the frame, and at least one of said frame halves has a groove at the inner side of the frame which faces the other frame half; and including a quantity of sealant lying in each of said grooves and extending between the frame halves, whereby to help keep out moisture.

11. A method for constructing an alarm screen comprising:

cutting a rectangular section from a mesh which includes a plurality of insulated security strands having conductive cores, so the security strands extend between opposite sides of the mesh;

laying an insulated cross wire having conductive cores, along each edge of the mesh and electrically joining the cores of the cross wires to cores of the security strands; and laying upper and lower portions of an insulative spline over the opposite faces of said mesh along at least opposite sides thereof to lie over locations where said security strands and cross wires are electrically joined, and joining said spline portions together through said mesh.

12. The method described in claim 11 wherein:

said spline comprises a block having a slot at the inside which extends only partially through the block, and said step of laying includes inserting the edge of said mesh in said slot.

13. An alarm screen assembly comprising:

a rectangular mesh sheet formed of perpendicular mesh strands and a limited number of spaced parallel security strands each formed of a conductive core surrounded by insulation, said security strands extending between first and second opposite sides of said mesh sheet; and a pair of cross connector wires each formed of a conductive core surrounded by insulation, each cross wire lying on a face of said mesh sheet along a different one of said sides thereof and inside the edge of the mesh sheet, a plurality of locations on each cross wire spot connected to the end portion of a security strand by connection of the conductive cores of the security strand and cross wire, and said cross wire being cut at locations between some pairs of security strands, to form a sinuous conductive path through said security strands and cross wires along the mesh.

14. The assembly described in claim 13 including:

a spline lying around the border of said mesh sheet and encapsulating portions of the cross wires and security strands at locations where they are in contact.

15. The assembly described in claim 14 including:

a frame which has a pair of members with a recess which can receive said spline, and with walls of said recess abutting portions of the spline which lie on opposite faces of the mesh sheet.

* * * * *